United States Patent [19]

Kenderi et al.

[11] Patent Number: 4,998,993

[45] Date of Patent: Mar. 12, 1991

[54] SPRAYING GUN

[76] Inventors: Tibor Kenderi; László Kenderi, both of Kelenhegyi ut 49, Budapest, Hungary

[21] Appl. No.: 662,232

[22] PCT Filed: Feb. 17, 1983

[86] PCT No.: PCT/HU83/00009

§ 371 Date: Oct. 5, 1984

§ 102(e) Date: Oct. 5, 1984

[87] PCT Pub. No.: WO84/03237

PCT Pub. Date: Aug. 30, 1984

[51] Int. Cl.[5] ..... B05B 7/24; B05B 7/30

[52] U.S. Cl. ..... 239/295; 137/893; 239/300; 239/341; 239/346; 239/371

[58] Field of Search ..... 239/295, 300, 337, 341, 239/346, 369, 371, 424, 417, 190, 11, 433; 137/893

[56] References Cited

U.S. PATENT DOCUMENTS

| | | | |
|---|---|---|---|
| 1,219,642 | 3/1917 | Isaacs | 239/300 |
| 2,614,000 | 10/1952 | Reinhold | 239/295 |
| 3,012,732 | 5/1959 | Kempthorne | 239/300 |
| 3,056,558 | 11/1960 | Gilliland et al. | 239/295 |
| 3,385,526 | 8/1966 | Furrer | 239/295 |
| 3,802,628 | 4/1974 | Goss et al. | 239/302 |
| 4,132,357 | 1/1979 | Blackinton | 239/11 |
| 4,186,772 | 2/1980 | Handleman | 137/893 |
| 4,502,640 | 3/1985 | Nonis | 239/346 |

FOREIGN PATENT DOCUMENTS

| | | | |
|---|---|---|---|
| 808310 | 7/1951 | Fed. Rep. of Germany | 239/295 |
| 2101725 | 7/1972 | Fed. Rep. of Germany | 137/893 |
| 2261986 | 6/1974 | Fed. Rep. of Germany | 239/302 |
| 691209 | 10/1979 | U.S.S.R. | 239/295 |

*Primary Examiner*—Andres Kashnikow
*Attorney, Agent, or Firm*—Schweitzer & Cornman

[57] ABSTRACT

There is disclosed a spraying gun in which the direction of the spray can be changed to make it possible to spray onto the back side of the object being sprayed. The gun comprises a feeding unit, a spraying unit and a connecting pipeline.

2 Claims, 4 Drawing Sheets

SPRAYING GUN

TECHNICAL FIELD

The invention relates to a spraying gun, in particular for applying and spraying, resp. dyestuffs, slurry and/or granular substances.

BACKGROUND ART

Different spraying, blowing devices, as e.g. dyestuff spraying guns, mortar throwers, sand blasting apparatuses, are widely used in the industry. The guns and apparatuses, resp. developed for the most diverse purposes meet more ar less the requirements. However, the known apparatuses have also well-known disadvantageous features. So, e.g. in the case fo dye sprayer operated with air-atomization, only highly diluted dyestuffs can be used. Although airless spraying guns are suitable for thicker dyestuffs, a special quality of dyestuff is nedded, and a they work at an overpressure of 120 to 160 which is disadvantageous from several point of view..

It is characteristic of all the known spraying guns that spraying is possible in the direction of the longitudinal axis, i.e. straight forward only. However, in practice one is often confronted with the task to coat the "backside" of pipes, cables, frameworks, etc. which are convered or concealed by a wall, i.e. surfaces ought to be coated which cannot be seen. This work is presently performed manually, using bent brushes. The drawback of this forcible solution lies in that partly manual work is expensive and unreliable, in addition to this live labour does not stay always available, in spite of high wages. A further disadvantage lies in the fact that there are coating materials, e.g. different slurries and dispersions, which cannot be applied on surfaces in the desired quality by using a brush.

The majority of the known spraying devices are discontinuously operated, accordingly automatic, continuous operation is not possible or one has to overcome considerable difficulties in this respect.

No spraying gun has become known up to now which would be equally suitable for spraying or blasting diluted and thick dyestuff, slurries containing rough particles or just dry particles, as e.g. corundum flasting onto the surfaces to be coated or cleaned.

DISCLOSURE OF INVENTION

The object of our invention is, in addition to being able to absolutely eliminate the above discussed deficiencies, suitable for spraying or blowing detergents, diluted dyestuff, thick dyestuff, diverse fibrous materials or particles containing slurries in a straight direction or at a predetermined angle for coating surfaces or for blasting of dry particles, as e.g. sand or crushing corundum or for the completely dust free blowing of slurry formed with abrasive particles for cleaning or roughing given surfaces.

The abject can be realized by using the sprying gun according to this invention. The spraying gun according to the invention comprises a feeding unit, a spraying head consisting of a material charging pipe a blast pipe enclosing the feeding pipe being, for example, parallel therewith and mutually removable, for controlling the material stream and thus the cone angle of the outlet stream, and an air-jet pipe confining an angle with the direction of the outlet stream, and a pipe line interconnecting the material feeding unit and the spraying head.

BRIEF DESCRIPTION OF DRAWING

The invention will now be described in detail by means of two preferred embodiments, by the aid of the drawings enclosed.

BEST MODE OF CARRYING OUT THE INVENTION

Figure 1:
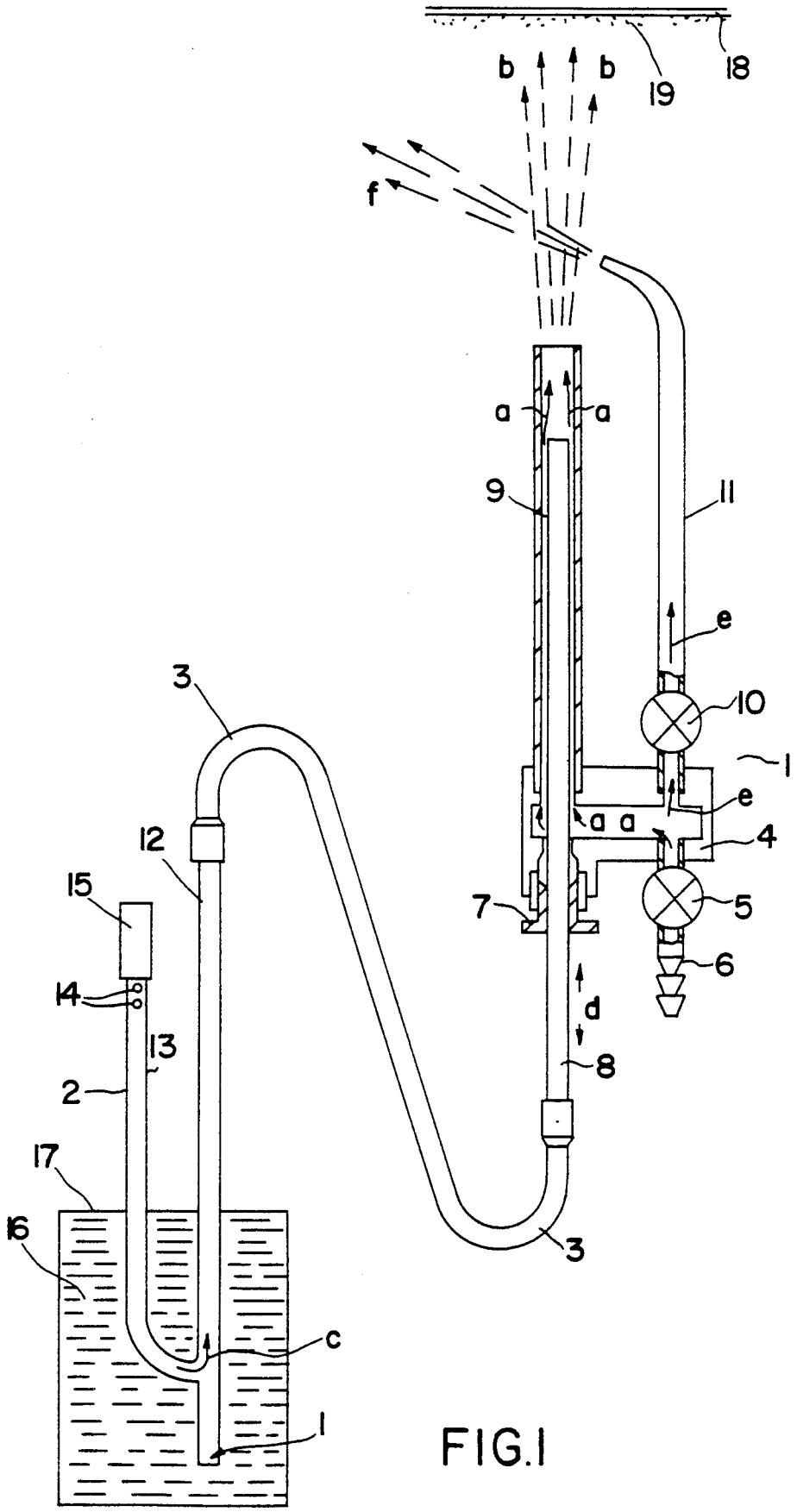
FIG. 1 shows a schematical side view of the spraying gun, partly in a sectional view.

According to this invention the spraying gun consists of three main parts: a spraying head 1, a material feeding unit 2 and a conveniently flexible pipeline 3 interconnecting the first mentioned two said parts. The essence of the spraying gun according to the invention lies in that it comprises a material feeding unit 2, a pipeline 3 connected on one end to said material feeding unit, and connected by the other end to a preferrably straight charging pipe 8. A blast pipe 9 concentrically encloses the material charging pipe 8 and controls the outlet material stream and thus of the cone angle of the material issuing therefrom. The blast pipe 9 is displaceable mutually and parallelly with the material charging pipe 8. A curved air-jet pipe 11 confines an angle with the direction of the outlet stream and serves to deflect the direction of the said outlet stream.

A how connection 6 provided with valve 5 is connected to a hollow body 4 of the spraying head 1. The material charging pipe 8 and the blast pipe 9 concentrically enclosing it are also connected to the hollow body 4 by means of a stuffing box 7 and a sealing. The curved air-jet pipe 77 having a flattened end is also connected to the hollow body 4 via and interconnecting valve 10.

The material feeding unit 2 consists of a material suction pipe 12 and a pipe 13 for the false-air connected thereto. On the upper end of the pipe 13 for the false-air there are air inlet bores 14. The free cross-section of said bores may be controlled by means of the locking cap 15 connected with a thread to the pipe 13 for the false-air. Material 16 to be sprayed is filled in a vessel 17 in which the material suction pipe 12 and pipe 13 for false-air are partially immersed The spraying gun operates as follows:

With a closed position of the valve 5 the apparatus is connected to the scource of the pressurized gas, e.g. compressed air, by the aid of the hose-connection 6, while the valve 10 is kept in a closed position. The feeding unit 2 is immersed into the material 16 to be sprayed contained in the open vessel 17. After the valve 5 is opened compressed air streams in the direction of the arrow a inducing a suction effect in the material charging pipe 8 (an ejector effect). Under the effect of suction the material 16 streams through the pipeline 3 and the material suction pipe 12. The material to be sprayed considerably accelerated and atomized in the blast pipe 9 is discharged in the direction of the arrows b and impacting on the surface 18 either forms the coating 19 or exerts a cleanning effect on the surface 18.

The suction effect, "ejector effect" ensuring the essence of the operation of the spraying gun can be controlled in a most intensive manner beside the proper dimensioning of the spraying gun also by changing the pressure of the compressed air and its quantity fed into the apparatus, resp. Intensity of suction can be controlled also by displacing the material charging pipe 8 in the direction of the arrow b. By the displacement of the charging pipe 8 quality of the atomization of the spraying material and the cone angle of the spray jet can also be controlled.

Figure 2:
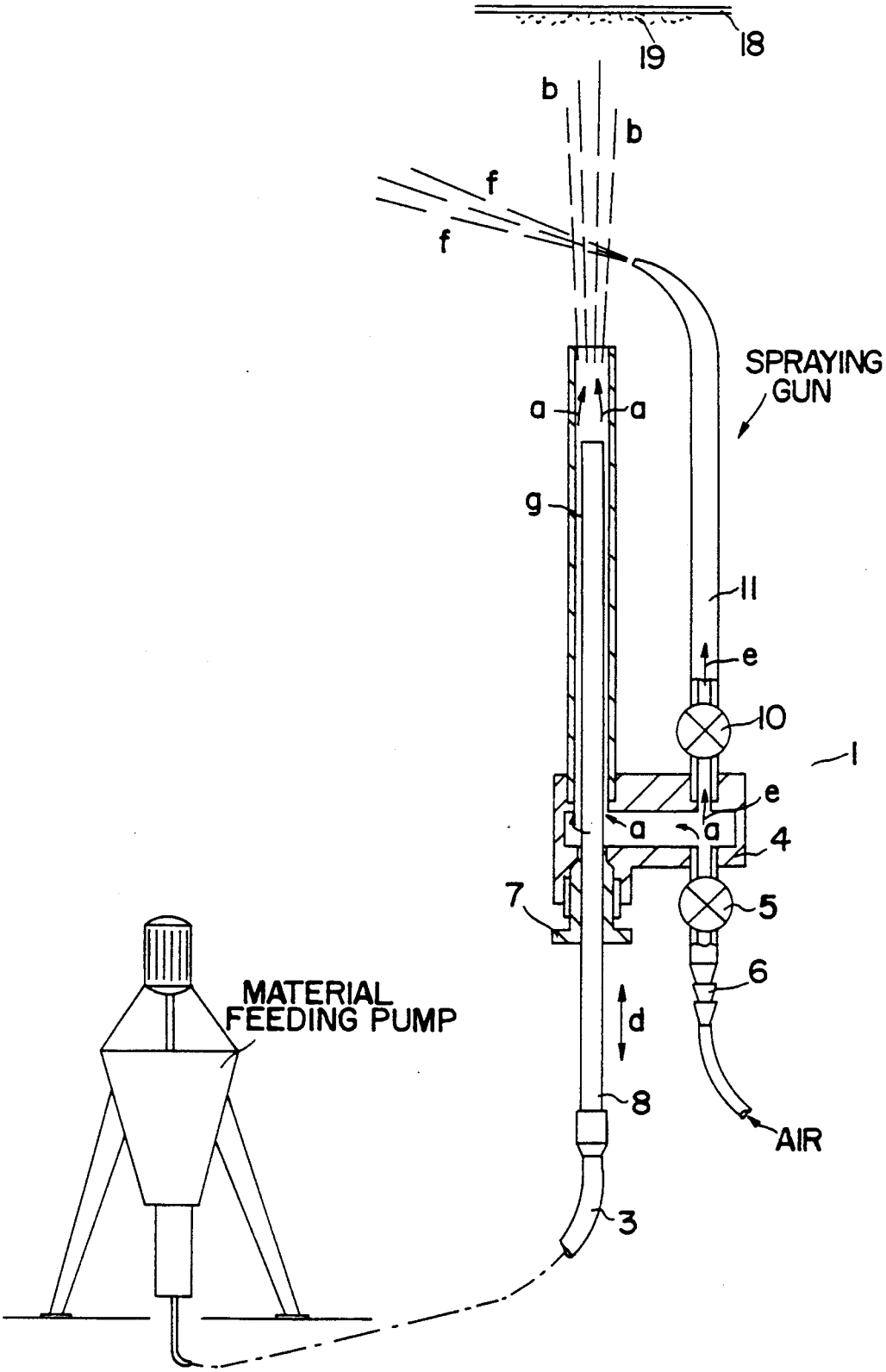
FIG. 2 is a schematic side view of the spraying gun with a material feeding pump.

The output of the spraying gun according to this invention can be increased to a multiple value also in the case of various dyestuffs, slurries and viscous substances if the substance to be sprayed has been fed into the material charging pipe 8 by means of a pump shown on FIG. 2 of the drawing, which pump can be connected to the pipeline 3. This embodiment has also the advantage that the spraying gun will become suitable also for the spraying of viscous substances which otherwise could not be fed into the device by means of the "ejector suction effect" itself as described above. This embodiment makes it also possible to feed the substance to be sprayed by means of a pump from a distance of about up to 20 m, for example on working sites which are difficult to access.

The quantity of the substances to be sprayed can be controlled infinitely by varying the free cross-sectional area of the air inlet bores 14 by screwing in and out, the locking cap 15, as well as the expedient selection of dimensions of the material feeding unit 2. If more air is admitted to pass through the pipe for the false-air 13, the said false-air, streaming in the direction of the arrow c, will reduced the intensity of suction at the end of the suction pipe 12 consequently the intensity of the stream of the spraying substance will decrease and in extreme case even the streaming stops at all.

After opening the air valve 10, the pressurized air streaming starts through the air-jet pipe 11 also in the direction of the arrow e. Afterwards it streams out with great velocity through the flattened end of the air-jet pipe 11 as through a small opening and deflects the blowing stream in the direction of the arrow f and thus creates an "angular blowing".

The deflection of the blowing angle in the direction of the arrow f of the dyestuff, slurry, etc. streaming in straight direction of the arrow b makes possible not only the coating of the not visible back side of different pipe lines, cables and iron constructions but in a surprising not aforeseable manner creates a very fine secondary pulverization of the substance to be sprayed and thus secures a very fine uniform distribution thereof.

In case of certain applications, by way of example in very narrow places, the spraying gun may be operated without using cross-pulverizer, in such cases, however, the advantageous additional effects, as discussed above, do not occur.

We claim:

1. A spraying gun for applying and spraying liquids and solid particulate materials such as dyestuffs, slurry or granular substances comprising a material feeding unit; a spraying head consisting of a straight material charging pipe, a blast pipe enclosing the charging pipe for controlling the material stream and the cone angle of the outlet stream, wherein said charging pipe and said blast pipe are parallely and mutually displacable relative to each other; and an air-jet pipe neither enclosing or enclosed by the charging pipe or the blast pipe defining an angle with the direction of the outlet stream for controlling the material stream direction; and a connecting pipeline interconnecting the material feeding unit and the spraying head, wherein said material feeding unit consists of (a) a pipe for false air connected to the connecting pipeline or to a material suction pipe in said material feeding unit connecting the said connecting pipeline with an open vessel or (b) a material feeding pump provided with a vessel connected to the connecting pipeline.

2. A spraying gun according to claim 1 wherein said material feeding unit consists of a material feeding pump provided with a vessel connected to the connecting pipeline.

* * * * *